US008344289B2

(12) United States Patent
Rogers et al.

(10) Patent No.: US 8,344,289 B2
(45) Date of Patent: Jan. 1, 2013

(54) TERMINAL BLOCK COOLING APPARATUS FOR AN ELECTRIC COOKING RANGE

(75) Inventors: Paul R. Rogers, Cleveland, TN (US); David R. Sampson, Charleston, TN (US); Gregory S. Wade, Anderson, SC (US)

(73) Assignee: Whirlpool Corporation, Benton Harbor, MI (US)

( * ) Notice: Subject to any disclaimer, the term of this patent is extended or adjusted under 35 U.S.C. 154(b) by 449 days.

(21) Appl. No.: 12/764,154

(22) Filed: Apr. 21, 2010

(65) Prior Publication Data

US 2011/0259870 A1 Oct. 27, 2011

(51) Int. Cl.

| | |
|---|---|
| ***A21B 1/00*** | (2006.01) |
| ***A21B 1/22*** | (2006.01) |
| ***F23M 7/00*** | (2006.01) |
| ***F24C 15/04*** | (2006.01) |

(52) U.S. Cl. ..... 219/394; 219/400; 126/198

(58) Field of Classification Search ..... 219/394, 219/400; 126/198

See application file for complete search history.

(56) References Cited

U.S. PATENT DOCUMENTS

| | | | | |
|---|---|---|---|---|
| 5,315,477 | A | 5/1994 | Schumacher et al. | |
| 5,734,149 | A | 3/1998 | Skutt et al. | |
| 5,781,411 | A | 7/1998 | Feenstra | |
| 6,172,338 | B1 | 1/2001 | Barnes et al. | |
| 6,872,921 | B1 | 3/2005 | DeCobert et al. | |
| 7,213,349 | B1 | 5/2007 | Brunner | |
| 7,251,133 | B2 | 7/2007 | Wallace | |
| 7,256,991 | B2 | 8/2007 | Sullivan | |
| 7,411,789 | B2 | 8/2008 | Nishimura | |
| 7,708,008 | B2 * | 5/2010 | Elkasevic et al. | 126/198 |
| 2005/0036258 | A1 | 2/2005 | Ma et al. | |
| 2009/0126146 | A1 | 5/2009 | Overvaag et al. | |

* cited by examiner

*Primary Examiner* — David S Blum

(74) *Attorney, Agent, or Firm* — Jason S. Burnette; Barnes & Thornburg

(57) ABSTRACT

An electric cooking range includes an oven having an electric baking element and a back panel positioned behind the oven. A spacer bracket is positioned between the back panel and an electrical terminal block. A bottom panel is positioned below the bracket and spaced apart from a number of mounting feet so as to create a gap between the bottom panel and the mounting feet. The bracket has a passageway positioned over an opening formed in the bottom panel such that when the baking element is energized, air from the gap is drawn into the passageway and advanced upwardly along the passageway.

16 Claims, 3 Drawing Sheets

TERMINAL BLOCK COOLING APPARATUS FOR AN ELECTRIC COOKING RANGE

TECHNICAL FIELD

The present disclosure relates generally to cooking ranges and more particularly to electric cooking ranges.

BACKGROUND

An electric cooking range is used to cook meals and other foodstuffs on a cooking surface or within an oven. Electricity is used to generate the heat necessary for cooking. Ranges typically include at least one terminal block where various internal electrical wiring is connected to an electrical power cord.

SUMMARY

According to one aspect, an electric cooking range is disclosed. The electric cooking range includes a number of mounting feet configured to contact a floor surface and a lower frame coupled to the mounting feet. The lower frame has a bottom panel spaced apart from the mounting feet so as to create a gap between the bottom panel and the mounting feet. A first oven is positioned above the lower frame, a second oven is positioned below the first oven and above the lower frame, and a back panel extends upwardly from the lower frame and is positioned behind the first oven and the second oven. An electrical terminal block is positioned behind the back panel, and a spacer bracket is positioned between the terminal block and the back panel. The spacer bracket has a passageway defined therein, and the passageway is positioned over an opening formed in the bottom panel such that when the second oven is operated, air is drawn from the gap into the passageway and advanced upwardly along the passageway.

In some embodiments, the terminal block may be secured to the bracket near an upper end of the passageway. In some embodiments, the bracket may include a body having a first surface and a second surface positioned opposite the first surface. The first surface of the body may have the terminal block secured thereto, and the second surface of the body may face the second oven.

In some embodiments, a plurality of holes may extend from the passageway to the first surface of the body such that air advancing upwardly along the passageway passes through the holes and flows over the terminal block. Additionally, in some embodiments, the cooking range may further include a bracket cover plate secured to the body of the bracket. The bracket cover plate may enclose the terminal block.

In some embodiments, the first oven may have a first electric baking element positioned below the first cooking chamber, the second oven may have a second electric baking element positioned below the second cooking chamber, and the bracket may be positioned behind the second electric baking element. In some embodiments, the passageway may be defined by a pair of side walls, and the bracket may include a flange extending over an upper end of the passageway such that air advancing through the passageway is directed out openings formed between the pair of sidewalls and the flange.

In some embodiments, the terminal block may be configured to receive a three-prong power cord.

According to another aspect, the electric cooking range includes a number of mounting feet configured to contact a floor surface and a lower frame coupled to the mounting feet. The lower frame has a bottom panel spaced apart from the mounting feet so as to create a gap between the bottom panel and the mounting feet. An oven is positioned above the lower frame. The oven has a cooking chamber defined therein and an electric baking element positioned below the cooking chamber. A back panel extending upwardly from the lower frame is positioned behind the oven. An electrical terminal block is positioned behind the back panel, and a spacer bracket is positioned between the terminal block and the oven. The bracket has a pair of sidewalls that define a channel therebetween. The channel is positioned over an opening formed in the bottom panel such that when the baking element is energized, air is drawn from the gap through the opening and advanced upwardly along the channel to an upper end of the bracket.

In some embodiments, the terminal block may be secured to the bracket at the upper end. In some embodiments, the bracket may include a flange positioned at the upper end that extends over the channel such that air advancing through the passageway is directed out openings formed between the sidewalls and the flange.

Additionally, in some embodiments, the cooking range may further include a second oven having a second cooking chamber defined therein. A second electric baking element may be positioned below the second cooking chamber. In some embodiments, bracket may be secured to the main back panel.

In some embodiments, each of the sidewalls may have a number of mounting flanges configured to contact the back panel. In some embodiments, the cooking range may further include a cooktop positioned above the first oven. The cooktop has a cooking surface, and, in some embodiments, the cooking surface may be positioned above an electric heating element.

BRIEF DESCRIPTION OF THE DRAWINGS

The detailed description particularly refers to the following figures, in which.

DETAILED DESCRIPTION OF THE DRAWINGS

Figure 1:
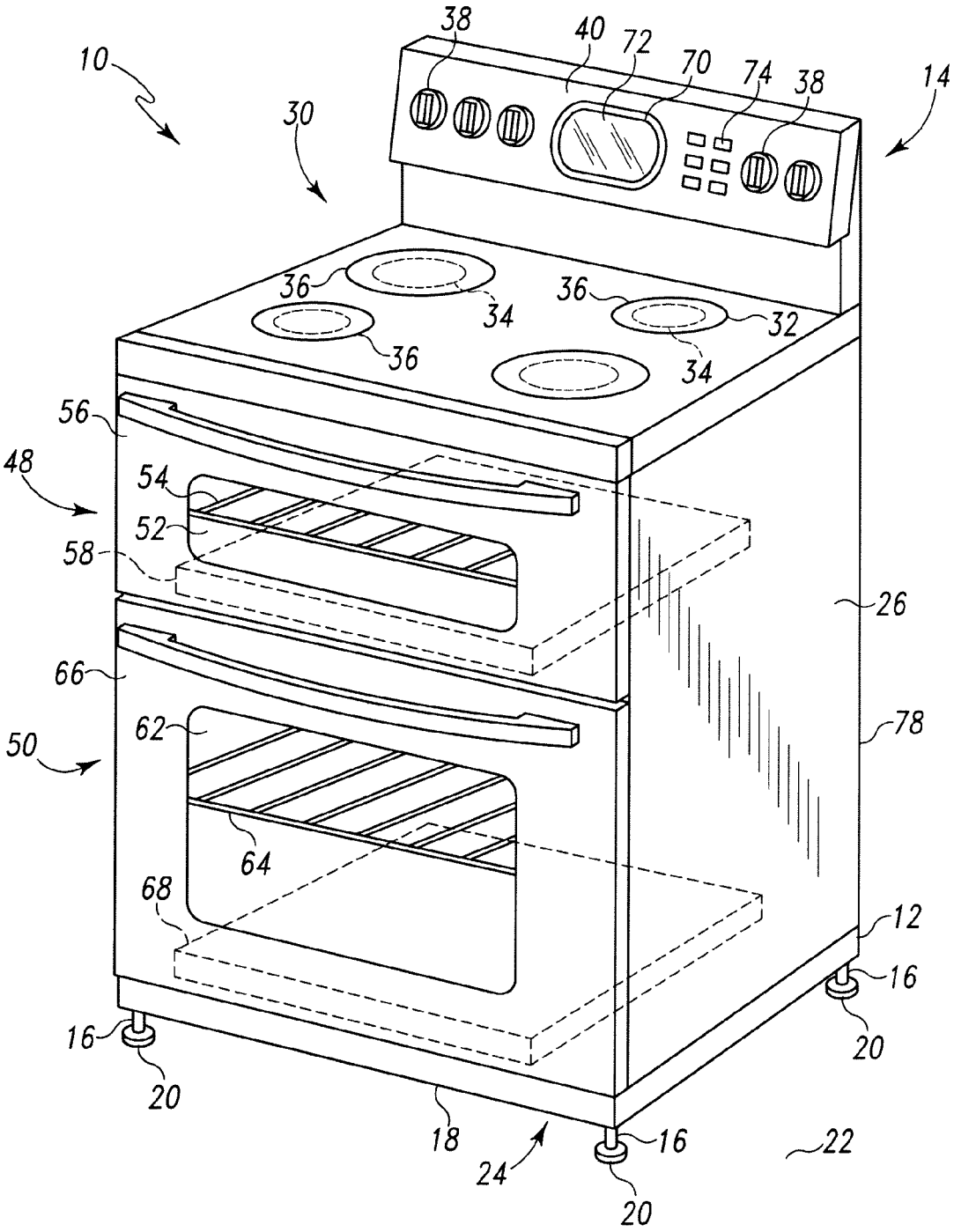
FIG. 1 is a perspective view of a electric cooking range.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

Referring to FIG. 1, an electric cooking range assembly 10 (hereinafter range 10) includes a lower frame 12 and an upper panel 14. The lower frame 12 includes a number of legs 16 extending downwardly from a bottom panel 18. Each of the legs 16 includes a mounting foot 20 that contacts a floor surface 22 of a home. A gap 24 is defined between the mounting feet 20 and the bottom panel 18 of the range 10. The legs 16 are located in each corner of the lower frame 12 and are adjustable to allow the user to level the cooking range 10 to compensate for any tilt or angle of the floor surface 22.

A housing 26 extends upwardly from the lower frame 12 to the upper panel 14. A cooktop 30 is secured to the housing 26 below the upper panel 14. As shown in FIG. 1, the cooktop 30 is a glass-ceramic cooktop. The cooktop 30 has a plurality of cooking areas 32, and a heating device 34 is positioned below each of the cooking areas 32. Each heating device 34 is operable to heat its corresponding cooking area 32 to desired cooking temperatures. An outer perimeter 36 designates to the user where the user should place pots, pans, and the like to be heated by each of the cooking areas 32.

Using a set of knobs 38 positioned on a control surface 40 of the upper panel 14, a user may separately control the temperature of each of the cooking areas 32. As the user rotates one of the knobs 38, a control switch (not shown) coupled to the knob 38 adjusts the heat generated by the corresponding heating device 34 to change the temperature of one of the cooking areas 32.

The housing 26 has an upper oven 48 and a lower oven 50 positioned therein. It will be appreciated that in other embodiments only a single oven may be positioned in the housing 26. The ovens 48, 50 are accessible from the front of the housing 26. The oven 48 has a cooking chamber 52 into which pans, sheets, or other cookware carrying food may be placed to be heated. The cooking chamber 52 includes a number of racks 54 located therein. A door assembly 56 is hinged to the front of the housing 26 and permits access to the cooking chamber 52. An electric baking element 58 is positioned below the cooking chamber 52 and is configured to generate heat for baking or otherwise cooking food items in the cooking chamber 52.

The lower oven 50 has a configuration similar to that of the upper oven 48. The lower oven 50 has cooking chamber 62 into which pans, sheets, or other cookware carrying food may be placed to be heated. The cooking chamber 62 includes a number of racks 64 located therein. A door assembly 66 is hinged to the front of the housing 26 and permits access to the cooking chamber 62. An electric baking element 68 is positioned below the cooking chamber 62 and above the lower frame 12. The baking element 68 is configured to generate heat for baking or otherwise cooking food items in the cooking chamber 62.

A user may control the operation of the baking elements 58, 68 using an interface 70 located on the control surface 40. The interface 70 includes a display 72 and a set of push buttons 74 that are connected to an automated control system (not shown) operable to control the operation of the baking elements 58, 68. For example, the user may use the interface 70 to set a desired temperature for each oven. The automated control system responds by supplying electrical power to the baking elements 58, 68 and adjusting amount of power supplied as necessary to heat the ovens 48, 50 to the desired temperatures.

Figure 2:
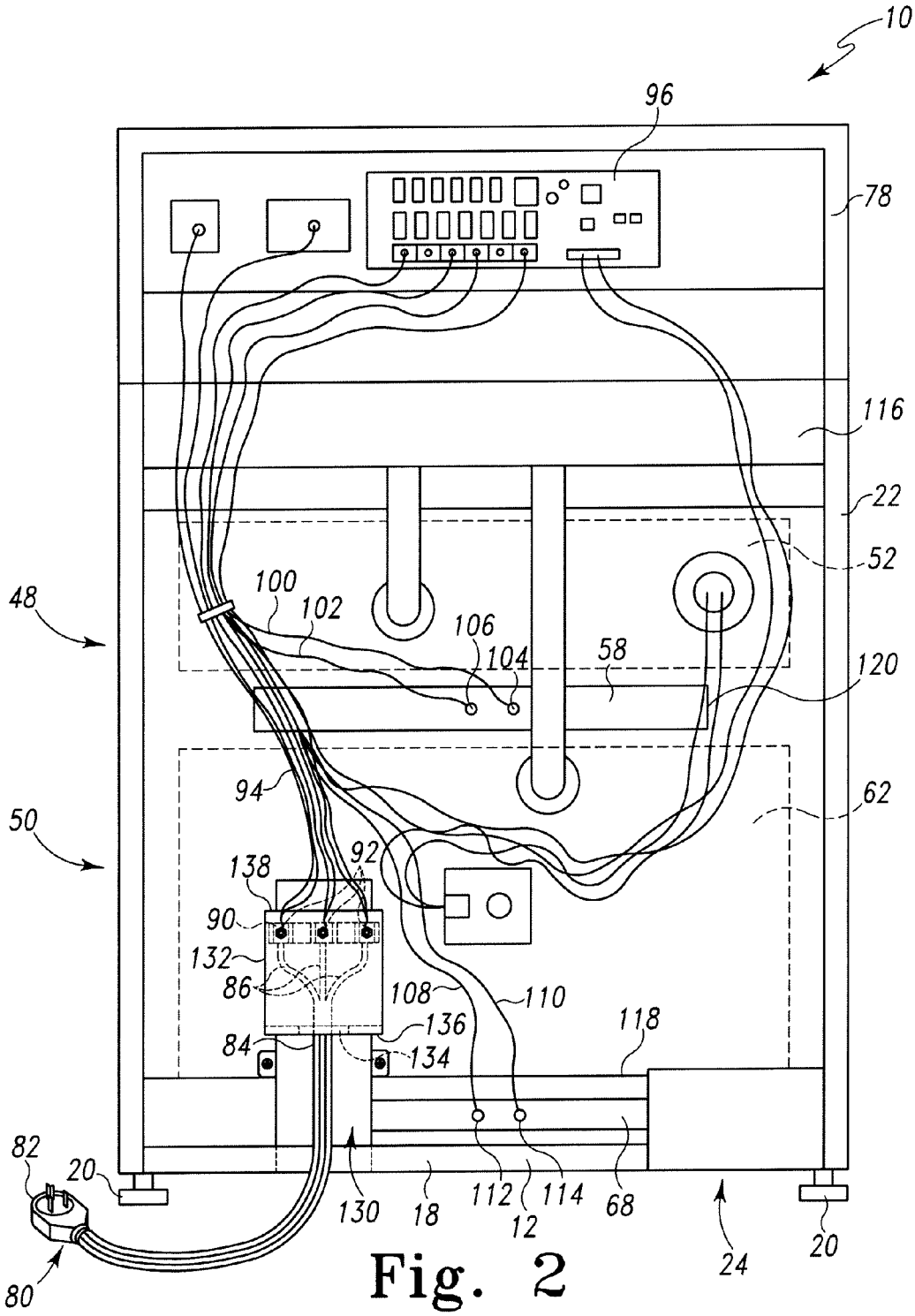
FIG. 2 is a rear elevation view of the electric cooking range of FIG. 1.

Referring now to FIG. 2, the back side 78 of the range 10 is shown with the cover panel (not shown) removed. The range 10 includes a power cord 80 that is configured to connect the range 10 to an external power outlet of a home (not shown). The power cord 80 extends from a head 82 to a tail 84. The head 82 has three prongs extending therefrom that are configured to be received in the external power outlet. It will be appreciated that in other embodiments the power cord may have four prongs.

The tail 84 is divided into three wires 86 that are secured to the electrical terminal block 90 of the range 10. Each of the three wires 86 is connected to a separate electrical connector 92 of the terminal block 90. A number of wires 94 connect the terminal block 90 to a power control circuit 96 positioned in the upper panel 14 of the range 10. A pair of wires 100, 102 extends from the power control circuit 96 to a pair of terminals 104, 106 extending from the baking element 58 of the upper oven 48. Similarly, a pair of wires 108, 110 extends from the power control circuit 96 to a pair of terminals 112, 114 extending from the baking element 68 of the lower oven 50. In that way, when the power cord 80 is connected to the external power outlet, the power control circuit 96 is operable to regulate the power supplied to the baking elements 58, 68 from the external power outlet of the home.

The housing 26 includes a main back panel 116 that extends from the lower frame 12 to the upper panel 14. The main back panel 116 has a lower slot 118 that receives the baking element 68. Similarly, the main back panel 116 has an upper slot 120 that receives the baking element 58. As shown in FIG. 2, the baking element 58 is positioned between the cooking chamber 52 of the upper oven 48 and the cooking chamber 62 of the lower oven 50.

The terminal block 90 is secured to a spacer bracket 130, which is positioned between the terminal block 90 and the main back panel 116. In that way, the terminal block 90 is spaced apart from the main back panel 116, which is heated by the cooking chambers 52, 62 when the baking elements 58, 68 are energized. As shown in FIG. 2, the terminal block 90 is positioned behind the lower oven 50, and the bracket 130 is positioned behind the baking element 68.

A cover plate 132 is secured to the bracket 130. As shown in FIG. 2, the cover plate 132 encloses the terminal block 90. The tail 84 of the power cord 80 extends through an opening 134 defined in a lower end 136 of the cover plate 132. The number of wires 94 connecting the terminal block 90 to the power control circuit 96 extend through an opening (not shown) defined in an upper end 138 of the cover plate 132.

Figure 3:
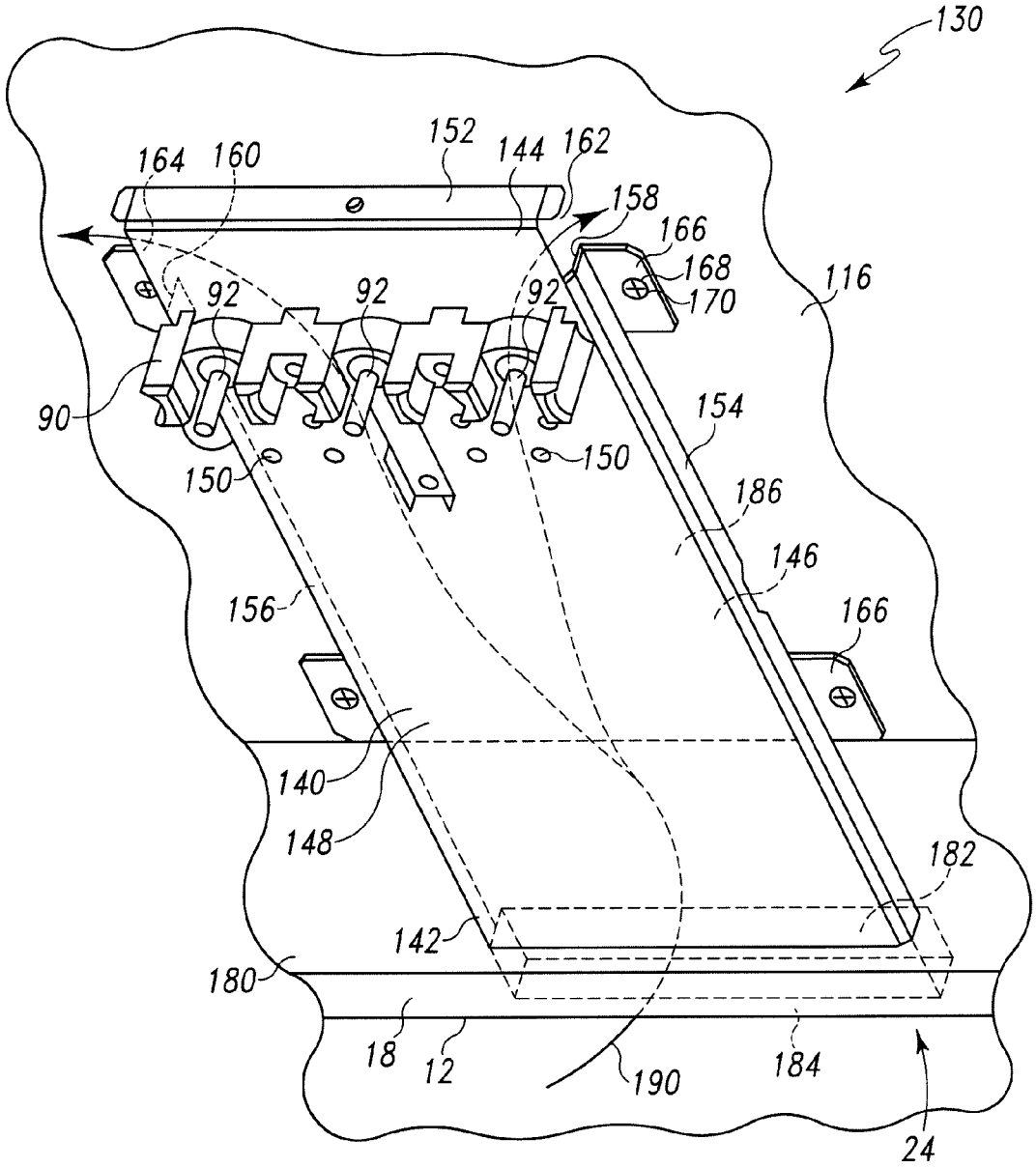
FIG. 3 is a fragmentary perspective view of the terminal block mounting bracket of the electric cooking range of FIG. 1.

Referring now to FIG. 3, the terminal block 90 and the bracket 130 are shown with the cover plate 132 and the wires 86 of the power cord 80 removed. The bracket 130 has a body plate 140 that extends from a lower end 142 positioned behind the baking element 68 (not shown) to an upper end 144. The body plate 140 has an inner surface 146 facing the main back panel 116 and an outer surface 148 positioned opposite the inner surface 146. The terminal block 90 is secured to the outer surface 148 of the body plate 140 at the upper end 144. A plurality of holes 150 extending from the inner surface 146 to the outer surface 148 are positioned below the terminal block 90.

A flange 152 extends from the inner surface 146 to contact the main back panel 116 at the upper end 144. A pair of side walls 154, 156 also extends from the inner surface 146 of the body plate 140 to contact the main back panel 116. In that way, the inner surface 146 is spaced apart from the main back panel 116. The side walls 154, 156 extend upwardly from the lower end 142 of the body plate 140 to ends 158, 160, respectively. The end 158 is spaced apart from the flange 152 such that an opening 162 is defined between the flange 152 and the side wall 154. The end 160 is similarly spaced apart from the flange 152 such that an opening 164 is defined between the flange 152 and the side wall 156.

A number of mounting flanges 166 extend from the side walls 154, 156. Each mounting flange 166 has a hole 168 formed therein that receives a bolt 170 or other fastener, which is received in a corresponding hole (not shown) formed in the main back panel 116. In that way, the bracket 130 is secured to the main back panel 116.

The lower end 142 of the body plate 140 is in contact with an upper surface 180 of the bottom panel 18 of the lower frame 12. A slot 182 extends from the upper surface 180 to a lower surface 184 of the bottom panel 18. The slot 182 is in fluid communication with the gap 24 defined between the mounting feet 20 and the bottom panel 18 of the range 10. It will be appreciated that in other embodiments there may be more than one slot formed in the bottom panel 18.

The body plate 140 has a channel 186 that is defined between the side walls 154, 156 of the bracket 130. The channel 186 extends upwardly from the lower end 142 to the flange 152 positioned at the upper end 144 of the body plate 140. The channel 186 is positioned over the slot 182 and is sized to match the width of the slot 182. Thus, the channel 186 and the slot 182 cooperate to place the openings 162, 164 defined between the flange 152 and the side walls 154, 156 in fluid communication with the gap 24 defined below the bottom panel 18. Similarly, the channel 186 and the slot 182 cooperate to place the holes 150 formed in the body plate 140 in fluid communication with the gap 24.

When either of the baking elements 58, 68 is energized, the air surrounding the terminal block 90 and the spacer bracket 130 is heated. The heated air will rise; thereby creating a vacuum that draws unheated air from the gap 24 defined between the mounting feet 20 and the bottom panel 18 of the range 10 into the slot 182. As shown in by arrows 190, the channel 186 acts as a passageway that guides the advancing unheated air to the upper end 144 of the body plate 140. In this way, the space between the terminal block 90 and the main back panel 116 is continuously replenished with cooling air while the range 10 is operated.

As the cooling air advances along the channel 186, some of the cooling air exits the channel 186 through the holes 150 formed in the body plate 140 and flows over the terminal block 90 and the wires 86. Cooling air advancing to the upper end 144 is directed out the openings 162, 164 defined between the flange 152 and the side walls 154, 156. The terminal block 90 and the wires 86 are thereby protected from the elevated temperatures generated by the baking elements 58, 68.

While the disclosure has been illustrated and described in detail in the drawings and foregoing description, such an illustration and description is to be considered as exemplary and not restrictive in character, it being understood that only illustrative embodiments have been shown and described and that all changes and modifications that come within the spirit of the disclosure are desired to be protected.

For example, in other embodiments the cooktop 30 may include a gas burner positioned below each of cooking areas 32. A grate may be positioned over each of the gas burners such that the grates define the upper surface of the cooktop. In such embodiments, each of the burners is configured to produce a controlled flame that generates a quantity of heat, which may be used to heat cooking utensils positioned on the upper surface. The burners may be arranged on the cooktop such that a user can simultaneously heat multiple pots, pans, skillets, and the like.

There are a plurality of advantages of the present disclosure arising from the various features of the method, apparatus, and system described herein. It will be noted that alternative embodiments of the method, apparatus, and system of the present disclosure may not include all of the features described yet still benefit from at least some of the advantages of such features. Those of ordinary skill in the art may readily devise their own implementations of the method, apparatus, and system that incorporate one or more of the features of the present invention and fall within the spirit and scope of the present disclosure as defined by the appended claims.

The invention claimed is:

1. An electric cooking range comprising:

a number of mounting feet configured to contact a floor surface, a lower frame coupled to the mounting feet, the lower frame having a bottom panel spaced apart from the mounting feet so as to create a gap between the bottom panel and the mounting feet, a first oven positioned above the lower frame, a second oven positioned below the first oven and above the lower frame, a back panel extending upwardly from the lower frame and positioned behind the first oven and the second oven, an electrical terminal block positioned behind the back panel, and a spacer bracket positioned between the terminal block and the back panel, wherein the spacer bracket has a passageway defined therein, the passageway being positioned over an opening formed in the bottom panel such that when the second oven is operated, air is drawn from the gap into the passageway and advanced upwardly along the passageway.

2. The cooking range of claim 1, wherein the terminal block is secured to the bracket near an upper end of the passageway.

3. The cooking range of claim 1, wherein:

the bracket includes a body having a first surface and a second surface positioned opposite the first surface, the first surface of the body has the terminal block secured thereto, and the second surface of the body faces the second oven.

4. The cooking range of claim 3, wherein a plurality of holes extend from the passageway to the first surface of the body such that air advancing upwardly along the passageway passes through the holes and flows over the terminal block.

5. The cooking range of claim 3, further comprising a bracket cover plate secured to the body of the bracket, the bracket cover plate enclosing the terminal block.

6. The cooking range of claim 1, wherein:

the first oven has a first cooking chamber and a first electric baking element positioned below the first cooking chamber, the second oven has a second cooking chamber and a second electric baking element positioned below the second cooking chamber, and the bracket is positioned behind the second electric baking element.

7. The cooking range of claim 1, wherein:

the passageway is defined by a pair of side walls, and the bracket includes a flange extending over an upper end of the passageway such that air advancing through the passageway is directed out openings formed between the pair of sidewalls and the flange.

8. The cooking range of claim 1, wherein the terminal block is configured to receive a three-prong electrical cord.

9. An electric cooking range comprising:

a number of mounting feet configured to contact a floor surface, a lower frame coupled to the mounting feet, the lower frame having a bottom panel spaced apart from the mounting feet so as to create a gap between the bottom panel and the mounting feet, an oven positioned above the lower frame, the oven having a cooking chamber defined therein and an electric baking element positioned below the cooking chamber, a back panel positioned behind the oven and extending upwardly from the lower frame, an electrical terminal block positioned behind the back panel, and a spacer bracket positioned between the terminal block and the oven, the bracket having a pair of sidewalls defining a channel therebetween, wherein the channel is positioned over an opening formed in the bottom panel such that when the baking element is energized, air is drawn from the gap through the opening and advanced upwardly along the channel to an upper end of the bracket.

10. The cooking range of claim 9, wherein the terminal block is secured to the bracket at the upper end.

11. The cooking range of claim 9, wherein the bracket includes a flange positioned at the upper end extending over the channel such that air advancing through the passageway is directed out openings formed between the sidewalls and the flange.

12. The cooking range of claim 9, further comprising a second oven, the second oven having a second cooking chamber defined therein and a second electric baking element positioned below the second cooking chamber.

13. The cooking range of claim 9, wherein the bracket is secured to the back panel.

14. The cooking range of claim 13, wherein each of the sidewalls has a number of mounting flanges configured to contact the back panel.

15. The cooking range of claim 9, further comprising a cooktop positioned above the first oven, the cooktop having a cooking surface.

16. The cooking range of claim 15, wherein the cooking surface is positioned above an electric heating element.

* * * * *